US007150576B1

(12) United States Patent
Kambeyanda

(10) Patent No.: US 7,150,576 B1
(45) Date of Patent: Dec. 19, 2006

(54) CLOG RESISTANT DRAIN

(76) Inventor: Dona M. Kambeyanda, 1230 Grace Ann Ct., Cordova, TN (US) 38018

( * ) Notice: Subject to any disclaimer, the term of this patent is extended or adjusted under 35 U.S.C. 154(b) by 0 days.

(21) Appl. No.: 11/376,536

(22) Filed: Mar. 15, 2006

Related U.S. Application Data

(60) Provisional application No. 60/661,780, filed on Mar. 15, 2005.

(51) Int. Cl.
*E03C 1/26* (2006.01)

(52) U.S. Cl. ..... 401/292; 401/652

(58) Field of Classification Search ..... 401/286–292, 401/652
See application file for complete search history.

(56) References Cited

U.S. PATENT DOCUMENTS

| | | | | |
|---|---|---|---|---|
| 965,836 | A * | 7/1910 | Ray | 210/315 |
| 1,035,733 | A * | 8/1912 | Pierce | 4/291 |
| 1,756,290 | A | 4/1930 | Hibner | |
| 2,191,686 | A | 2/1940 | Shenk | |
| 2,498,502 | A | 2/1950 | O'Brien | |
| 2,505,305 | A | 4/1950 | Schaefer | |
| 2,859,452 | A | 11/1958 | Seewack | |
| 3,982,289 | A | 9/1976 | Robbins | |
| RE31,561 | E | 4/1984 | Thompson | |
| 6,016,579 | A * | 1/2000 | Erbs | 4/631 |
| 6,067,669 | A | 5/2000 | Peterson et al. | |
| 6,263,518 | B1 | 7/2001 | Magtanong | |
| 6,802,424 | B1 | 10/2004 | Ouyoung | |
| 2004/0107489 | A1 | 6/2004 | Caterina | |
| 2004/0144703 | A1 | 7/2004 | Davenport | |

* cited by examiner

*Primary Examiner*—Huyen Le
(74) *Attorney, Agent, or Firm*—Wyatt, Tarrant & Combs, LLP

(57) ABSTRACT

A clog free drain for a surface water drain such as that utilized in a tub or stall shower including a basket having side openings permitting waste water to flow there through and into the drain pipe in which the basket is disposed. Directing waste water into the basket is by a sleeve located coaxially of the basket and the drain pipe and below the drain plate whereby the waste water flows through the sleeve, out an opening in the bottom thereof in to the closed bottom of the basket. The waste water accumulates below and into the sleeve and into the basket to a level of the side openings in the basket where it flows into the drain pipe. Pooling of the waste water in the bottom of the basket allows the debris, hair, soap scum and other suspended particles to accumulate in the bottom of the basket and thus separated from the waste water flowing in to the drain pipe.

14 Claims, 4 Drawing Sheets

CLOG RESISTANT DRAIN

CROSS REFERENCE TO RELATED APPLICATIONS

This application claims benefit of prior U.S. Provisional Application Ser No. 60/661,780, filed Mar. 15, 2005, the content of which is fully incorporated herein by reference.

STATEMENT REGARDING FEDERALLY SPONSORED RESEARCH OR DEVELOPMENT

Not applicable

REFERENCE TO A MICROFICHE APPENDIX

Not applicable

FIELD OF THE INVENTION

The present invention relates to surface drains for plumbing, such as for floor drains, kitchen and bathroom sinks, bath tubs, and showers. Due to the flexible sizing and unique features, it may also be utilized as a large capacity drainage for floors, large sinks and special purpose drains. In particular, the invention relates to apparatus for straining out particulate material sloughed into waste water such as hair while bathing, or grease and small food particles such as coffee grinds in the kitchen sink, while collecting the particulate matter and keeping it from later clogging the drain. This invention, in particular, uniquely prevents the passing of grease and soap, thereby preventing build up along the drain pipes as when such react with the other smaller particles including minerals suspended in the water.

BACKGROUND OF THE INVENTION

Drains, such those for kitchen sinks, tubs and showers, clog due to collection of particles suspended in the waste water flow, such as hair. Soap, grease, and skin oils bond small particles such as hair, minerals and food particles to clog pipes. At some point in time in the history of the usage of the drain, one or another of harsh and/or toxic chemicals, or the use of a rotary router are necessarily administered by such as a licensed plumber to clear the impediments to free the flow of the waste water. Alternatively, as the impediments to free flow build, there is an additional development of unsanitary conditions, as soap scum, dirt and related products of bathing and/or kitchen grease being trapped in the drains by the collection of debris because of the inherent reduction of water flow due to the conventional filtering and screening apparatus. Soap scum is the hard, scaly build-up in drains due to the soap reacting with minerals in the water. Most existing drains either provide no restriction of usual sloughed waste, allowing build-up to occur in the interstices of the building plumbing, or require complicated, and thus time consuming, requiring professional emptying or clearing. This invention addresses the issue of scum build-up due to soap and other oils. The drain cleaning procedure is uncomplicated and simple, without the use of acid and/or base chemical cleaners which can be toxic.

There have been numerous attempts at producing a suitable drain, however inadequacies exist including restriction of the flow of drain water through the use of smaller apertures in filters, screens and the like. Inevitably, soap scum builds up to become an accelerator of clogging due to its being captured and acting as a coagulant around the hair and other collected debris. Several of these unsuccessful products are represented by several of the many patents and publications which have issued over a considerable span of years. Among these are U.S. Pat. No. 6,263,518 to Magtanong which discloses a strainer 20, of sorts which has an upper closed end which forces water exiting a shower base through a drain plate 70 to flow around the strainer, diverted into a lateral or spiral pattern by protuberances 120 which also are said to capture hair and other particles and caused to drop down into a collection area 100 formed by a peripheral ridge 90 sealed against drain pipe 10. The suction effect described of the water flowing through orifices 130 purportedly will further assist the flow of the particles and hair through the apertures, leaving the same problem of restricted high volumes of water to flow quickly and effectively through the drain.

U.S. patent to Peterson, et al illustrates a drain plug assembly acting as a stopper as well as a strainer to capture debris which might otherwise cause clogging of the drain. The strainer is a basket-like cylindrical container with a closed bottom (other than the hole to accommodate mounting on a boss 20. The drain water is forced to flow outwardly through slots in the vertical wall of the basket 30 and downwardly adjacent the drain wall. The slots are said to also serve to capture the particles and hair in the waste flow, which inevitably will cause constriction of the flow and need for frequent cleaning, if the slots act as described. By placing the slots laterally, essentially creating apertures on the sidewalls, the original issue of tying the aperture size to the size of particle restricted still exists since these two elements continue to remain in direct proportion to each other. The present invention provides unrestricted flow of the waste water into and through the drain and provides adequate retention space for long-term operation. The present invention also deposits all particles into the basket before allowing waste flowing out of the sides, thereby overcoming this proportionally restrictive element in all existing drain strainer designs.

U.S. Pat. No. RE. 31,561 to Thompson illustrates a simple, large strainer basket disposed intermediate the drain plate and the drain. The invention is directed to the structural features of the basket and its mounting and does not disclose any features for improving the drain flow. Specifically, the present invention is directed to the capturing of the small particles without restricting the flow of liquid by staying independent of the aperture size along the sidewalls, prevents clogging.

U.S. Pat. No. 3,982,289 to Robbins is directed to a disposable sink (kitchen) strainer. The strainer is used in conjunction with the standard basket to collect garbage and the like and to be disposed of when filled.

U.S. Pat. No. 2,859,452 to Seewack is directed to an improvement in shower drain construction. It illustrates a drain and sub-drain combination for connecting the shower plate portion of the drain to the main drain, including a secure combination of corrosion resistant materials. There is no illustration of features to improve the capture of potentially harmful waste products from bathing.

U.S. Pat. Nos. 2,505,305 and 2,498,502 to Schafer and O'Brien, respectively, are directed to large basket strainers for sinks, adapted to collect food debris and other refuse during sink use. The baskets are easily removed for dumping to a garbage disposal or other refuse container. Again, in both of these inventions, the apertures placement along the lateral sidewall still makes the restriction of smaller particles dependant on the aperture size which would restrict liquid flow. The lateral or horizontal placement does not eliminate this dependency, which is addressed by the present invention. Also, neither invention is adaptable for such as shower use or for large capacity drainage purposes, wherein the strainer is installed for longer term and high capacity use.

U.S. Pat. No. 2,191,686 to Shenk is directed to a sink or shower drain wherein an annular slot is provided intermediate the strainer basket and the drain pipe such that on filling and resultant clogging, the waste water unable to flow through the basket is permitted to escape through the annular opening, directly to the drain, thereby avoiding an overflow or flooding situation. As with the previously discussed drain structures, there is no analogous structure to the present invention to provide continued effective collection of debris, soap scum and hair while maintaining full flow of the waste water through the drain.

The present invention overcomes several shortcomings of these prior art drain devices, as will be further evident from the succeeding description.

SUMMARY OF THE INVENTION

It is an object of the present invention to provide a drain straining mechanism that does not restrict the flow of waste water through the drain into the sewer collection piping, while effectively trapping small and larger particles including oils and soap which combine with water and other small particles to form hard build-up, thereby clogging drains. The apparatus is simple in construction, inexpensive to produce in that common plumbing materials are used and that it does not require any custom manufacturing or installation for use.

In its preferred embodiments the inventive drain strainer enhances collection of soap scum build-up, particularly as it bonds to hair and food particles and subsequently to sewer pipe surfaces requiring later use of acid or base cleaners which are known toxicants or the physical introduction of a flexible router.

In its preferred embodiment, the apparatus is adapted to be installed into a standard drainpipe such as that at the bottom of a shower which empties into the sewer and includes a generally cylindrical basket disposed in sleeved relation within the drain adjacent the opening, as at the shower base. The lateral cylindrical side of the basket includes openings, which in the preferred embodiment illustrated are vertically extending parallel slots, arranged in a ring around the lateral side. The lower extent of the slots terminate in a plane P above the closed bottom of the basket. The lateral side of the basket is disposed adjacent, but distanced from the wall of the drain pipe a selected distance to provide unobstructed flow of waste water out of the basket into the pipe and subsequent sewer. Disposed within the basket is a cylindrical sleeve, mounted under the drain plate whereby waste water in the shower is directed from the drain plate into the sleeve. The sleeve terminates in an opening at a preferable level of about one-half the distance D above the bottom of the basket. Thus, waste water, such as exiting the shower, flows through the drain plate, into and through the sleeve, emptying into the space in the basket below the sleeve. Since the level of the bottom of the sleeve is below the plane of the basket slots, the waste water pools, permitting the debris particles, hair and soap scum to settle into the bottom of the basket. Only as the water level in the sleeve/basket rises to the plane of the bottom of the slots, does the collecting waste water then exit to the sewer pipe. Accordingly, the overall flow of waste water is allowed to continue unchecked, however removed are the debris, hair and soap scum.

The foregoing and other objects, features, aspects and advantages of the invention will become more apparent from the following detailed description of the invention when considered in conjunction with the accompanying drawings.

PREFERRED EMBODIMENTS OF THE INVENTION

In the following detailed description of the preferred embodiments, reference is made to the accompanying drawings which form a part hereof, and in which are shown specific embodiments in which the invention may be practiced. It is to be understood that other embodiments may be utilized and structural changes within the skill of the art may be made without departing from the scope of the present invention.

Figure 1:
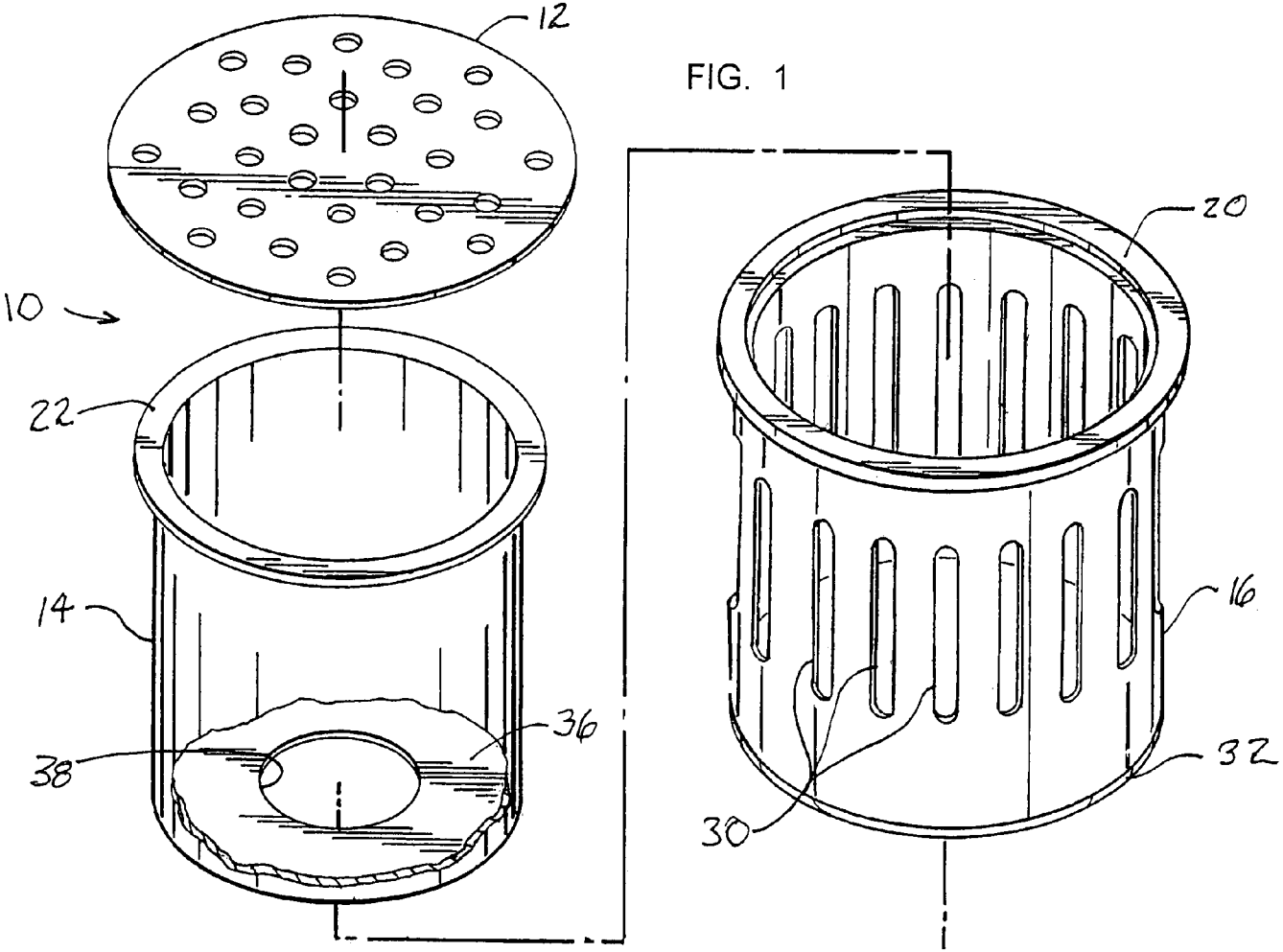
FIG. 1 is an exploded view of the of the clog resistant drain
Figure 2:
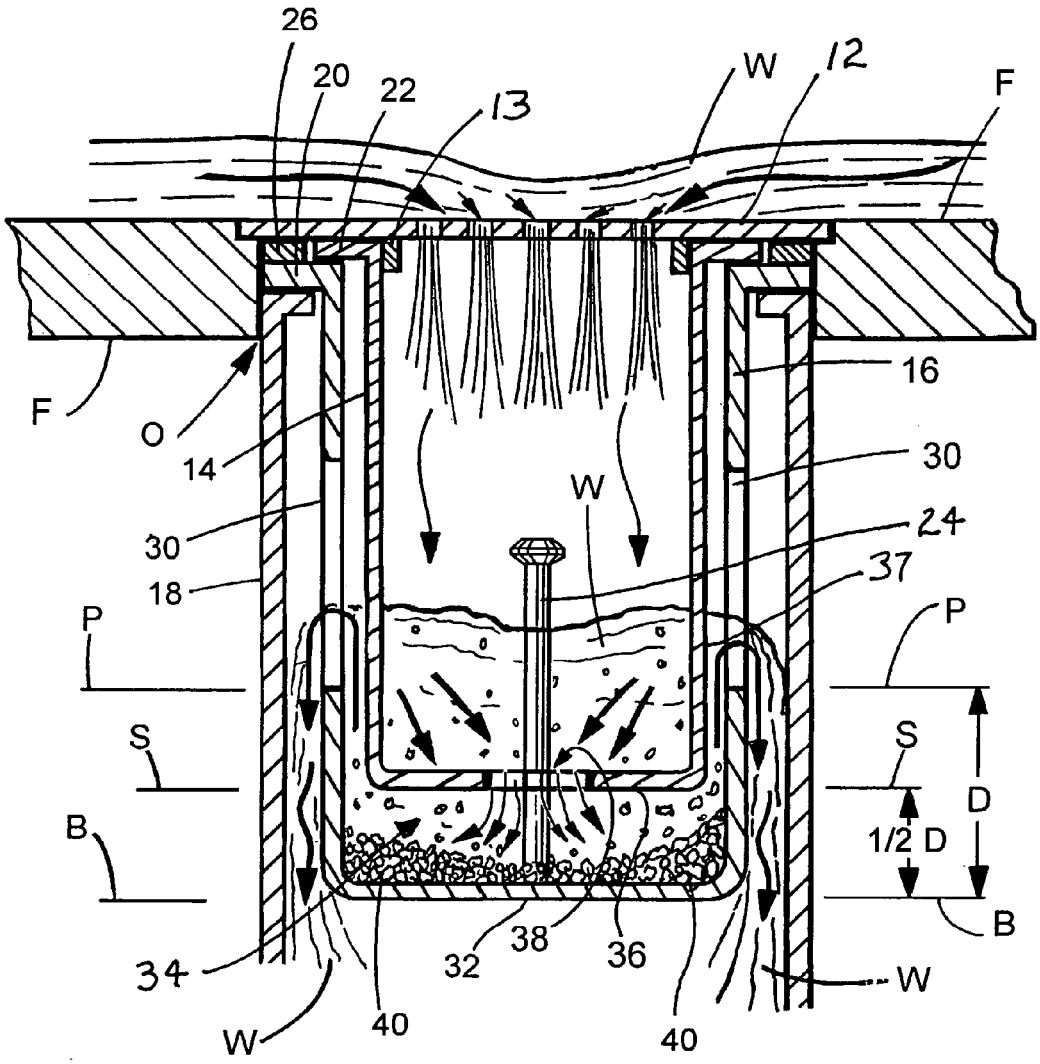
FIG. 2 is a vertical cross sectional view of the invention of FIG. 1 wherein the flow of drain water through the drain is illustrated.

As shown in FIGS. 1 and 2, the present invention is a clog free drain 10 including a drain plate 12, a sleeve 14, and a basket 16. Drain plate 12 is a common element of floor mounted drain systems such as a stall shower and certain tubs. As illustrated in FIG. 2, the drain plate 12 is disposed in the floor or other support plane F, generally over the drain pipe 18 which carries the waste water off to the sewer system (not shown). Basket 16 conventionally includes such as an annular flange 20 to support the basket 16, such as on the upper reach of the drain pipe 18, at an appropriate level under the drain plate 12 which will accommodate the similar coaxial mounting of sleeve 14 under drain plate 12 and intermediate it and the basket 16. Those skilled in the art will recognize that the coaxial mounting of the three components may be accomplished by known alternative means as by such as threaded, pinned and keyed connections. In the instant embodiment sleeve 14 includes an annular flange 22 whereby sleeve 14 is centrally (coaxially) retained within basket 16 and drain pipe 18. Flange 22 may fully overlap flange 20, abutting the wall of opening 0 into which the drain pipe is secured, or intermediate means such as a removable bushing or gasket 26 as illustrated in FIG. 2. Likewise, drain plate 12 is illustrated as including a reinforcement ring 13 which might be included for a drain plate of substantial diameter or exposed to surface loading. Basket 16 is also illustrated as including an optional handle 24, centrally disposed for facilitated removal and cleaning. Those skilled in the art will recognize that alternative embodiments of handles such as bails, rods and loops may be chosen, as may be advantageous.

Basket 16 includes openings 30 in its cylindrical sidewall 31 enabling waste water W to flow there-through to the drain pipe 18. In the illustrated embodiment the openings 30 are parallel slots disposed preferably, but not necessarily symmetrically thereabout. The openings 30 extend from a bottom plane P disposed at a predetermined distance D above the bottom 32 of the basket. Openings 30 may be of other configuration such as oval, circular, or rectangular, and exhibiting a total surface area sufficient to accommodate the anticipated flow of waste water W to within a rise of about one-half the depth of basket 16. Likewise, the diameter of basket 16 is such that the free space between sidewall 31 and the adjacent drain pipe 18 accommodates at least an equivalent flow as described above with respect to openings 30. Those skilled in the art will recognize that the required capacity of drain 10 components is set by the maximum anticipated flow of water into the system, as by output of a faucet, shower head and the like. These flow figures are published in the package materials accompanying such products. Flow rates generally are in the range of about 1.5 to 2.5 gallons per minute but might be as high as 10 gallons per minute for special applications.

Sleeve 14 is likewise disposed coaxially in basket 16 and drain pipe 18, and has a diameter less than basket 16 such that flow of waste water out of sleeve 14 into basket is approximately equivalent to that of basket 16 into pipe 18. Sleeve 14 has a vertical dimension sufficient to extend from drain plate 12 to a bottom plane S coincident with sleeve bottom 36 at sidewall 37 wherein the preferable distance between plane S and plane B is about one-half the distance D. Combined with an exit opening 38 in the bottom 36 of a size to accommodate the described anticipated flow of waste water W, a flow is maintained within the basket reservoir 34 (being the space or volume within the basket 16 below the lower reach of slots 30) such that it is slowed to allow the settling of debris, hair and the like as illustrated at 40 in FIG. 2. While opening 38 is illustrated as a singular circular opening, other shapes can accommodate the required flows. Likewise, while a single opening is preferred, multiple patterns may be used.

For most low-capacity drains such as common-place/household applications (kitchen/bath sink, shower/tub drains), there is no critical requirement to forcibly maintain a steady state flow, since the water will just back up in the sink without any backflow or outflow without particle entrapment. This preferred flow is laminar since applications involve small areas and heights and relatively low velocities and volumes. The Reynolds number (flow rate measurement) is well below the threshold for turbulence for pipes, even those as small as one inch, particularly for a flow rate on the order of 1 liter/min (Re<2300, i.e., laminar flow); and flow rate of 1 gallon per minute (Re<4000, transitional flow). For a typical drain of two inches, a sidewall spacing of about ⅛ inch to ¼ inch between the sleeve 16 and basket 14 is adequate to permit laminar, unrestricted flow. Spacing between the bottom 32 of the basket 16 and the bottom of sleeve 14 is recommended at about ¼" up to about one inch for a typical low-capacity/household drain. Maintaining the bottom of the slots 30 in basket 16 at about ½" above the bottom of basket (again, for a typical drain) ensures that the water backflow into sleeve is controlled, as by being generally in a laminar flow. It is also possible to build this drain strainer 10 in a larger dimension (preferably at about 3") and fitted with a well, tubing or other adapter fit to the typical/required drain pipe dimension.

For unique waste liquids (such as fluids with higher viscosity than water or soap water), or high-capacity strainer (i.e., large volume) applications involving larger areas/drains to avoid turbulent flow, due to viscosity and large volumes, resulting in/or backup in the sleeve 14. In such instances, it is important to make sure that the hydraulic diameter (different from geometric diameter) of the basket is the same as the diameter of the sleeve. In other words, the difference between the inside radius of the basket (ir 16) and the outside radius of the sleeve (or 14) should be one-half that of the inside radius of the basket 16. The added spacing between basket 16 and sleeve 14 facilitate the laminar flow of viscous fluids as well as higher than normal volumes.

The illustrated and described preferred embodiment has the following approximate dimensions, all relative to the diameter of the drain opening and service drain pipe 18 serving it. By way of example for an approximate 3 inch drain, as might be found in a shower, the diameter of the basket is approximately about two and one-half inches and that of the sleeve is approximately about two inches. The length/depth of basket 16 in this embodiment is about two and one-half inches and that of the sleeve 14 is about two inches. Distance D is thus about one half inch and D is about one inch. Sleeve opening 38 is about one inch in diameter.

Figure 3:
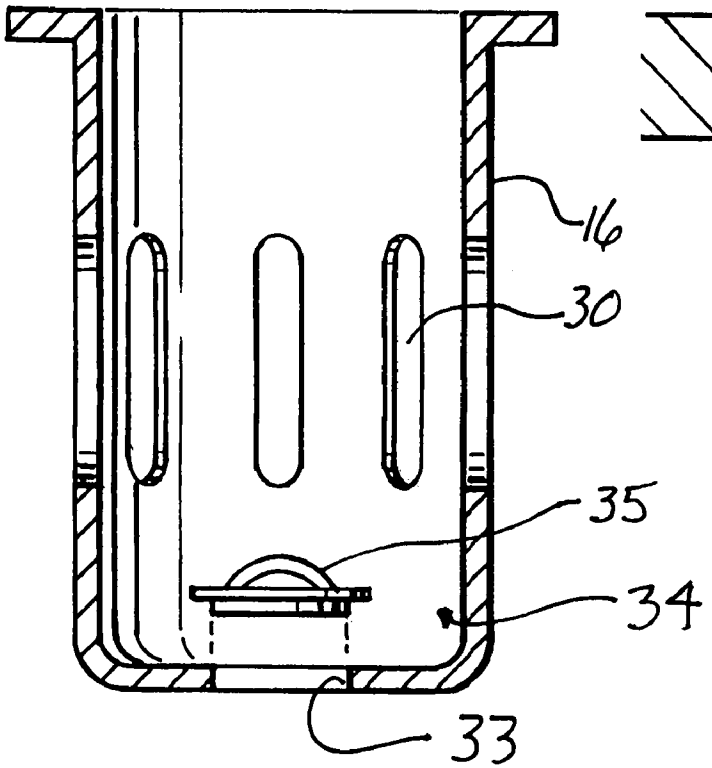
FIG. 3 is a cross sectional view of an alternate embodiment of the basket of the invention of FIG. 1 wherein the basket includes a removable drain plug.

FIG. 3 illustrates an alternative embodiment of basket 16 wherein the bottom of the basket 16 includes an opening 33 having a removable cap 35. Such a means enables the basket reservoir 34 (the bottom volume of the basket 16 which enables the collection of waste water and the settling out of the suspended particles such as hair, and inclusions such as soap scum, to be emptied directly into the drain 18. This would normally only be elected when there is a build-up of benign particles, such as sand.

Figure 4:
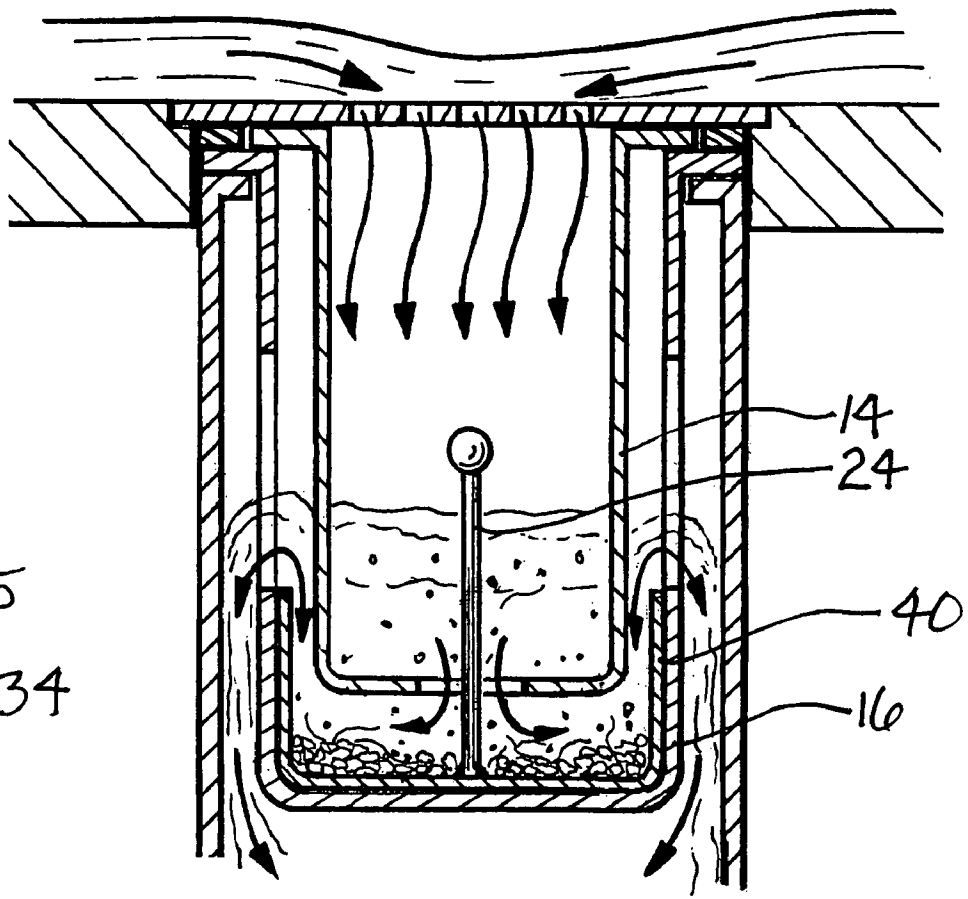
FIG. 4 is a cross sectional view of an alternative embodiment of the invention of FIG. 1 wherein the basket includes a grasping handle and a removable cup.

FIG. 4 illustrates an alternative embodiment of basket 16 including a disposable cup 40 closely received in the basket reservoir 34. The use of a removable cup 40 (whether disposable or reusable) enables an expeditious removal of built-up debris. If the cup 40 is reusable, it is merely emptied and wiped clean and replaced. Perhaps more convenient is the use of a disposable cup 40 which may be discarded and replaced with a new replacement. Both versions are illustrated with a handle 24 (which may be a variety of configurations from the post shown to a bail or otherwise) to facilitate the removal of cup 40.

Figure 5:
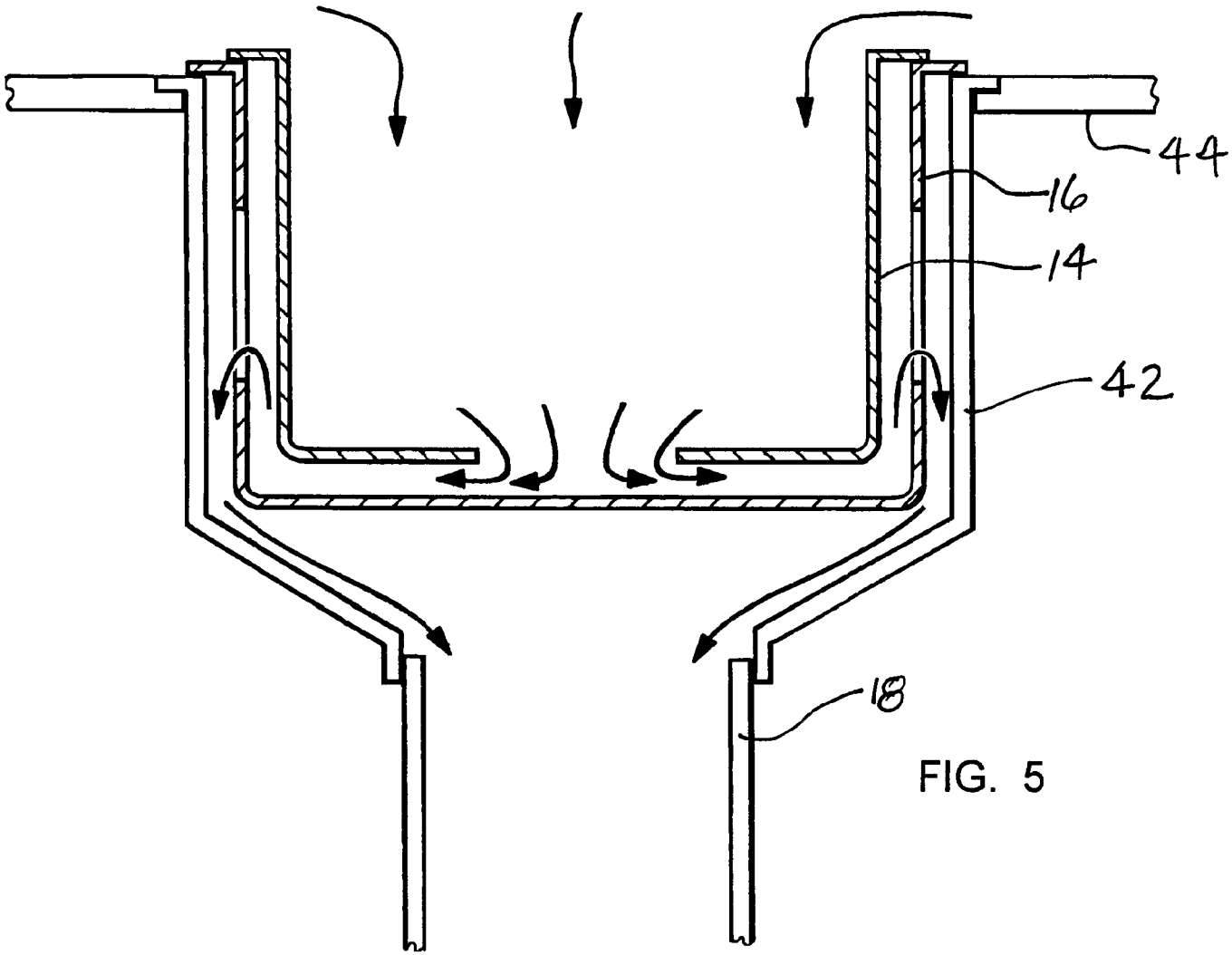
FIG. 5 is a cross sectional view of an alternative embodiment of the invention illustrated in FIG. 1 adapted with a drain well for installation with reduced diameter drain pipe.

FIG. 5 illustrates still another alternative of the drain system 10 wherein the overall dimension are altered for a larger drain profile. In the illustrated embodiment, a drain well 42 is attached to the drain pipe 18, as by traditional method (welding, cementing, threaded coupling, and the like) and the basket 16 and sleeve 14 are disposed therein as in the related embodiments. By means of this alternative, a larger basket may be utilized with a smaller drain, as in a kitchen sink application. Conventionally, such applications include a larger orifice from the sink basin 44 (partially shown) and include an additional strainer (not shown). Alternatively, rather than the fully vertical sidewalls 31, 37, such may be angled, complementary to drain well 42 and provide added volume and smoothe flow of waste water. The illustrated embodiment also enables utilization in applications wherein there is reduce space available under the installation to accept an axially longer configuration as illustrated in FIG. 2.

The various components of the invention are manufactured of materials customarily used in surface water drains, including plastics such as PVC, copper, aluminum and other metal alloys. It is a matter of convenience to select the material of such a s the basket to be a disposable wherein replacement involves merely discarding the basket and replacing it with another replaceable basket. In the alternative use of a permanent basket, the basket is conveniently removed, cleaned and replaced.

The following is a list of the reference numbers and associated parts for the invention as shown and described:

| | |
|---|---|
| 10 | clog free drain |
| 12 | drain plate |
| 14 | sleeve |
| 16 | basket |
| 18 | drain pipe |
| 20 | basket flange |
| 22 | sleeve flange |
| 24 | handle |
| 26 | gasket |
| 30 | slots |
| 31 | basket sidewall |
| 32 | basket bottom |
| 33 | basket opening |
| 34 | basket reservoir |
| 35 | removable cap |
| 36 | sleeve bottom |
| 37 | sleeve sidewall |
| 38 | sleeve opening |
| 40 | basket cup |
| 42 | drain well |
| 44 | sink basin |
| B | sleeve bottom plane |
| D | distance |
| F | floor |
| 0 | floor opening |
| P | slot opening plane |
| S | sleeve bottom plane |
| W | waste water |

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

I claim:

1. A drain strainer system comprising:

a drain plate, a sleeve and a basket, coaxially mountable in a generally cylindrical drain pipe;

the basket having a generally cylindrical wall terminating in a closed bottom with a plurality of drain water flow openings disposed circumferentially in a region in the cylindrical wall, said flow openings region having an upper and lower extent at predetermined distance above the closed bottom;

the basket having a diameter smaller that the drain pipe sufficient for drain water flow traversing the flow openings to freely traverse the openings and flow through the drain pipe;

the sleeve having a generally closed cylindrical sidewall and an open bottom coaxially disposed within the basket, the sleeve having a predetermined axial length relative to the basket so as to terminate with the opening a predetermined distance above the bottom of the basket, sufficient to permit drain water flow to pool to a depth of at least the lower level of the flow openings in the basket before traversing the flow openings and entering the drainpipe;

The sleeve cylindrical sidewall further having a predetermined outside diameter with respect to the inside diameter of the basket wall; and the drain plate coaxially disposed over the basket and sleeve and having drain holes therein and a diameter larger than the basket and the sleeve so as to direct all drain water flow through the sleeve and basket.

2. The drain strainer system of claim 1 wherein the flow openings in the basket wall are symmetrically disposed circumferentially around the flow opening region.

3. The drain strainer system of claim 2 wherein the flow openings are vertically disposed slots.

4. The drain strainer system of claim 3 wherein the flow openings are of equal vertical length.

5. The drain strainer system of claim 1 wherein the bottom opening of the sleeve is disposed axially below the lower extent of the flow opening region of the basket by at least one-half the distance between the lower extent of the flow openings and the basket bottom.

6. The drain strainer system of claim 1 wherein the upper surface of the closed bottom of the basket has a textured surface.

7. The drain strainer system of claim 6 wherein the closed bottom of the basket includes a close fitting, removable central insert.

8. The drain strainer system of claim 7 wherein the removable disk is disposable.

9. The drain strainer system of claim 7 wherein the insert is cup-shaped having an upward extent not exceeding the lower extent of the flow openings.

10. The drain strainer system of claim 9 wherein the cup has a central handle to assist removal.

11. The drain strainer system of claim 7 wherein the basket has a central opening in the bottom and the insert is closely received therein.

12. The drain strainer system of claim 1 wherein the predetermined wherein the sleeve terminates above the basket bottom is at least about ten percent of the diameter of the basket.

13. The drain strainer system of claim 1 wherein the inside diameter of the basket wall is at least about ten percent larger than the outside diameter of the sleeve sidewall.

14. The drain strainer system of claim 1 wherein the strainer system includes a generally cylindrical well, the well having a lower neck portion of reducing diameter to a fixed opening, said fixed opening adapted to be affixed to a drain pipe.

* * * * *